US007363101B2

(12) United States Patent
Nishitani et al.

(10) Patent No.: US 7,363,101 B2
(45) Date of Patent: Apr. 22, 2008

(54) KNITTING MACHINE, YARN PROCESSING METHOD OF KNITTING MACHINE, YARN PROCESSING CONTROL DEVICE OF KNITTING MACHINE AND PROGRAM THEREOF

(75) Inventors: Hirokazu Nishitani, Wakayama (JP); Takeshi Okamuro, Wakayama (JP); Mitsuo Kubo, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 11/577,383

(22) PCT Filed: Sep. 28, 2005

(86) PCT No.: PCT/JP2005/017822

§ 371 (c)(1),
(2), (4) Date: Apr. 17, 2007

(87) PCT Pub. No.: WO2006/043398

PCT Pub. Date: Apr. 27, 2006

(65) Prior Publication Data

US 2007/0260353 A1 Nov. 8, 2007

(30) Foreign Application Priority Data

Oct. 19, 2004 (JP) ..... 2004-303761

(51) Int. Cl.
*G06F 19/00* (2006.01)
*D04B 15/66* (2006.01)

(52) U.S. Cl. ..... 700/141; 66/126 R

(58) Field of Classification Search ..... 66/146, 66/125 R, 132 T, 126 R, 210, 213; 700/130–133, 700/141
See application file for complete search history.

(56) References Cited

U.S. PATENT DOCUMENTS

| | | | | |
|---|---|---|---|---|
| 5,369,966 | A | 12/1994 | Morita et al. | |
| 5,606,875 | A * | 3/1997 | Nishitani et al. | 66/77 |
| 5,671,614 | A * | 9/1997 | Shima | 66/125 A |
| 6,010,052 | A * | 1/2000 | Leins et al. | 99/146 |
| 6,550,285 | B2 | 4/2003 | Nishitani | |
| 7,055,349 | B2 * | 6/2006 | Morita et al. | 66/146 |
| 7,113,844 | B2 * | 9/2006 | Komura | 700/141 |

* cited by examiner

*Primary Examiner*—Danny Worrell
(74) *Attorney, Agent, or Firm*—Rothwell, Figg, Ernst & Manbeck, P.C.

(57) ABSTRACT

A knitting machine, a method of working yarn by the knitting machine, and a controller for working yarn by the knitting machine and its program. In the method, a carriage is controllably stopped at a point where a yarn passage length between a yarn working device and a knitting needle obtained by assuming that a buffer length on a tension arm is maximum matches a residual knitting length left before knitting at a point where yarn working is performed. When the carriage is stopped, the buffer length of a first arm is measured, a yarn is delivered from the yarn working device by an amount of difference between the buffer length and the maximum value thereof, and the yarn is worked in synchronism with the application of a tension to the yarn by releasing a second arm. Thus, the yarn can be worked at specified positions.

8 Claims, 7 Drawing Sheets

2

KNITTING MACHINE, YARN PROCESSING METHOD OF KNITTING MACHINE, YARN PROCESSING CONTROL DEVICE OF KNITTING MACHINE AND PROGRAM THEREOF

CROSS REFERENCE TO RELATED APPLICATION

This application is a 35 USC § 371 National Phase Entry Application from PCT/JP2005/017822, filed Sep. 28, 2005, and designating the United States.

TECHNICAL FIELD

The present invention relates to the control of yarn processing for a knitting machine, and particularly to the control of a knotter, a splicer, an adhering device, a yarn dyeing apparatus, and other apparatuses for splicing yarns in the middle of knitting in order to change the colors, thickness, texture and the like of knitting yarns.

BACKGROUND ART

In Japanese Patent No. 2816784, the consumed yarn length of each loop to be knitted from the changeover position, which is located on the knitting fabric for changing over a knitting yarn to an after-processed yarn, to the actuating position of the yarn processing device is added reversely to the order of knitting, whereby the total yarn length (remaining length to be knitted W) is obtained from knitting data. Furthermore, the yarn length between the yarn processing position and the knitting needle that is the actuating position of the yarn processing device (yam guide length L) is obtained. The yarn processing is performed when the remaining length to be knitted W and the yarn guide length L match. Also, Japanese Unexamined Patent Application Publication No. 2002-227064 discloses that yarn is held between a pair of rollers to control the amount of yarns to be fed, and the yarns are fed to the yarn feeder side.

Incidentally, a knitting machine, such as a flat knitting machine, is provided with a tension arm to buffer yarn before a needle bed. Since the buffer length (slack length) of the yarn on the tension arm constantly changes, considered is to monitor the angle of the tension arm in order to accurately obtain the timing for processing the yarn using a yarn processing device. However, it is not enough to simply obtain the buffer length on the tension arm. It is often the case that if the pattern of deceleration of a carriage or the like is defined such that the carriage or the like is stopped at the point of time when the yarn guide length obtained after correcting the buffer length on the tension arm matches with the remaining length to be knitted W, the tension changes during a processing of stopping the carriage or the like and the buffer length on the tension arm also changes, whereby the yarn guide length no longer matches with the remaining length to be knitted W at the point of time when the carriage is stopped.

DISCLOSURE OF THE INVENTION

A fundamental object of the present invention, therefore, is to process yarn at a predetermined position and improve the accuracy of the yarn processing position even when the yarn is buffered by an arm located on an upstream side of a needle bed and thereby the buffer length of the yarn on the arm changes.

An additional object of the present invention is to provide a concrete configuration for realizing the above-described object.

A knitting machine of the present invention is a knitting machine that supplies yarn from a yarn processing device to a knitting needle of a needle bed in order of a buffering arm and a yarn feeder, compares remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at a position of actuating the yarn processing device to feed the knitting yarn to the knitting needle, and thereby controlling the timing for operating the yarn processing device, the knitting machine having: a sensor for obtaining buffer length of the arm from the direction of the arm; means for comparing the yarn guide length L in preset buffer length of the arm with the remaining length to be knitted W, to control deceleration of knitting speed so that the knitting speed becomes zero or a low speed at the needle bed at the point of time when a yarn feeding position C is reached when $L \leqq W$ is satisfied; and timing means for obtaining the buffer length of the arm at the yarn feeding position C by means of the sensor, and operating the yarn processing device at the point of time when reeling out, from the yarn processing device side to the needle bed side, yarn of a length corresponding to the difference between the preset buffer length of the arm and the buffer length obtained by the sensor.

Preferably, the preset buffer length of the arm is substantially equal to the maximum buffer length of the arm and is in the range of, for example, ±20% of the maximum buffer length.

Preferably, the knitting machine also has a roller and a motor for reeling out yarn, and the motor is used to reel out, from the yarn processing device side to the needle bed side, the yarn of a length corresponding to the difference between the preset buffer length of the arm and the buffer length obtained by the sensor.

Preferably, the yarn feeder is moved at a low speed to draw out, by knitting operation, the yarn of a length corresponding to the difference between the preset buffer length of the arm and the buffer length obtained by the sensor.

Preferably, a yarn length measuring device is provided between the yarn processing device and the buffering arm.

A yarn processing method of the knitting machine of the present invention is a method for supplying yarn from a yarn processing device to a knitting needle of a needle bed in order of a buffering arm and a yarn feeder, comparing remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at a position of actuating the yarn processing device to feed the knitting yarn to the knitting needle, and thereby controlling the timing for operating the yarn processing device, wherein the knitting machine is provided with a sensor for obtaining buffer length of the arm from the direction of the arm, and wherein the yarn processing method comprises the steps of: comparing the yarn guide length L in preset buffer length of the arm with the remaining length to be knitted W, and controlling deceleration of knitting speed so that the knitting speed becomes zero or a low speed at the needle bed at the point of time when a yarn feeding position C is reached when L≦W is satisfied; and obtaining the buffer length of the arm at the yarn feeding position C by means of the sensor, and operating the yarn processing device at the point of time when reeling out, from the yarn processing device side to the needle bed side, yarn of a length corresponding to the difference between the preset buffer length of the arm and the buffer length obtained by the sensor.

A yarn processing control device of the knitting machine of the present invention is a yarn processing control device for a knitting machine for controlling yarn processing performed by supplying yarn from a yarn processing device to a knitting needle of a needle bed in order of a buffering arm and a yarn feeder, comparing remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at a position of actuating the yarn processing device to feed the knitting yarn to the knitting needle, and thereby controlling the timing for operating the yarn processing device, the yarn processing control device having: a sensor for obtaining buffer length of the arm from the direction of the arm; means for comparing the yarn guide length L in preset buffer length of the arm with the remaining length to be knitted W, to control deceleration of knitting speed so that the knitting speed becomes zero or a low speed at the needle bed at the point of time when a yarn feeding position C is reached when L≦W is satisfied; and timing means for obtaining the buffer length of the arm at the yarn feeding position C by means of the sensor, and operating the yarn processing device at the point of time when reeling out, from the yarn processing device side to the needle bed side, yarn of a length corresponding to the difference between the preset buffer length of the arm and the buffer length obtained by the sensor.

A program of the yarn processing control device of the present invention is a program for controlling yarn processing for a knitting machine by supplying yarn from a yarn processing device to a knitting needle of a needle bed in order of a buffering arm and a yarn feeder, comparing remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at which the actuating position of the yarn processing device feeds the knitting yarn to the knitting needle, and thereby controls the timing for operating the yarn processing device, the program having: a command to compare the yarn guide length L in preset buffer length of the arm with the remaining length to be knitted W, to control deceleration of knitting speed so that the knitting speed becomes zero or a low speed at the needle bed at the point of time when a yarn feeding position C is reached when L≦W is satisfied; and a timing command to obtain the buffer length of the arm at the yarn feeding position C by means of the sensor, to operate the yarn processing device at the point of time when reeling out, from the yarn processing device side to the needle bed side, yarn of a length corresponding to the difference between the preset buffer length of the arm and the buffer length obtained by the sensor.

The type of the knitting machine is, for example, a flat knitting machine, but a circular knitting machine or the like may also be applied. The remaining length to be knitted W is a total value obtained from knitting data and obtained by summing up consumed yarn length of each loop to be knitted from a changeover position on a knitting fabric for changing over a knitting yarn to an after-processed yarn to an actuating position of the yarn processing device. The consumed yarn length of each loop to be knitted from the changeover position on the knitting fabric to the actuating position of the yarn processing device is summed up, for example, in an order reverse to the knitting order. In this invention, the knitting speed is set to zero or low speed at a position where L≦W is satisfied, and the buffer length of the arm obtained at this moment is set to a value of equal to or more than actual buffer length, thus, at the point of time when the knitting speed is zero or a low speed (a decelerated point C, also referred to as "yarn feeding position C"), there is a margin M before the yarn is processed. It should be noted that "low speed" is, for example, ¼ or less, preferably 1/10 or less of normal knitting speed. Also, in this specification, the disclosure of the knitting machine directly applies to the yarn processing method of the knitting machine, the yarn processing control device of the knitting machine, or the program of the yarn processing control device of the knitting machine. The other way around is also possible: the disclosure of the yarn processing method of the knitting machine or the yarn processing control device of the knitting machine also directly applies to the knitting machine and the program of the yarn processing control device of the knitting machine.

A knotter cuts yarn to bind it with different yarn, and a splicer cuts and twists yarn to unbind it, and then twists it for linking with different yarn. An adhering device also cuts yarn and adheres it to different yarn. In the case of a yarn dyeing apparatus, an objective is to obtain the timing for replacing a dye pad. In such case, yarn processing is performed in relation to pad replacement and the like instead of dyeing. Therefore, in the yarn processing device it is preferred that the knitting speed be zero or low speed when processing yarn.

In this invention, the yarn guide length L and remaining length to be knitted W based on the preset value of the buffer length of the arm are compared with each other, and the knitting speed is controlled to be decelerated so that the knitting speed becomes zero or a low speed at the yarn feeding position C satisfying W≧L. Then, actual buffer length of the arm is obtained at the yarn feeding position C by means of the sensor, and the yarn processing device is operated at the point of time when reeling out, from the yarn processing device side to the needle bed side, yarn of a length corresponding to the difference between the preset buffer length of the arm and the buffer length obtained by the sensor. Therefore, the yarn processing can be performed at an approximate target position, and as a result, the yarn can be processed at a desired position even when the buffer length of the arm fluctuates, whereby the color, texture, thickness, material and the like of the yarn can be changed.

Furthermore, once the value of the difference between the preset buffer length and the buffer length obtained by the sensor is defined, if, for example, the knitting machine has a motor for reeling out yarn, this reel motor can be used to reel out a predetermined length of yarn and process the position at a desired position.

Moreover, once the value of the difference between the preset buffer length and the buffer length obtained by the sensor is defined, yarn equivalent to this value may be reeled out by knitting at a low speed. Reeling out by using the reel motor or by knitting are basically the same thing.

EXPLANATION OF REFERENCE NUMERALS

Figure 1:
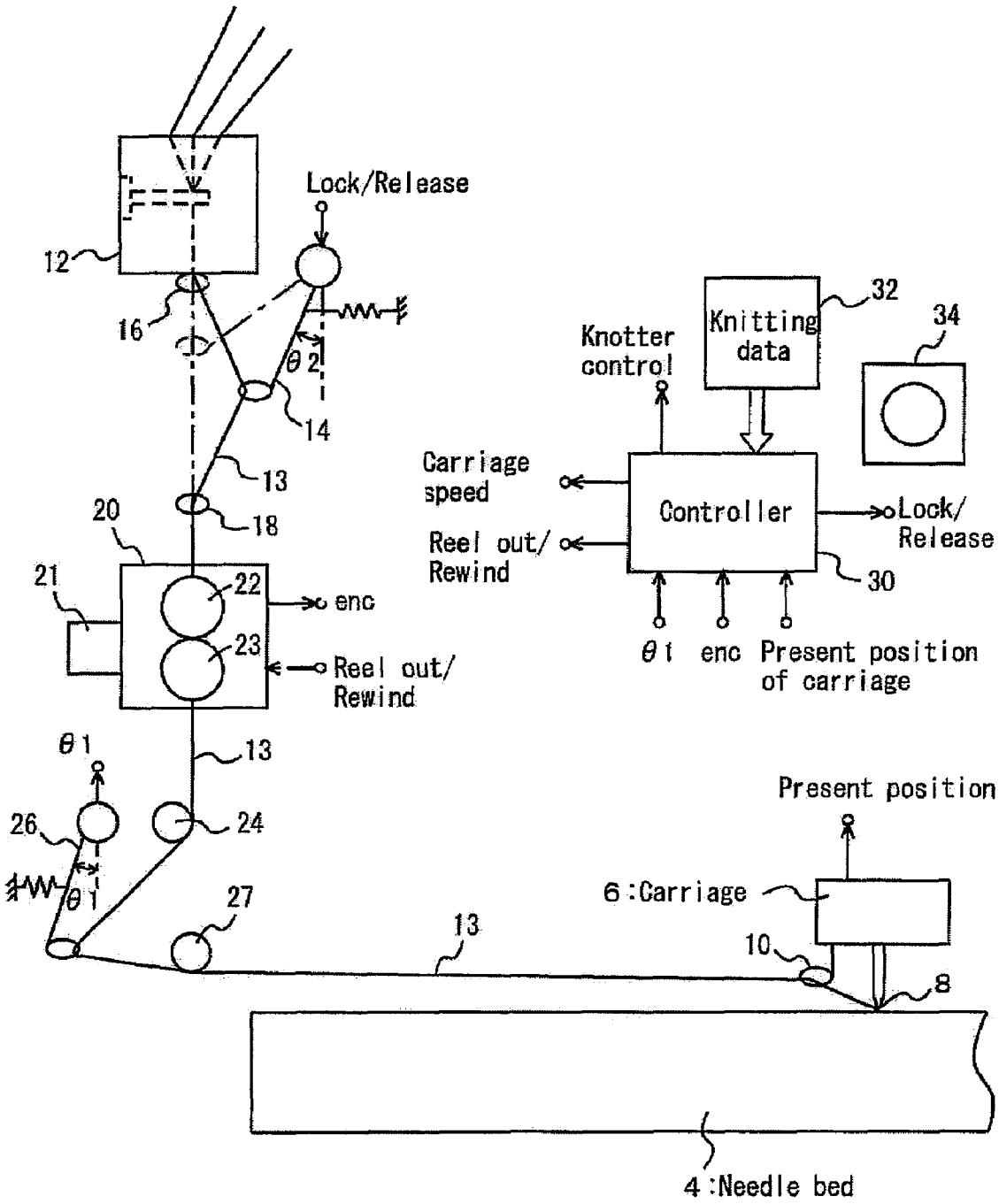
FIG. 1 is a block diagram of a flat knitting machine of an embodiment.

2 flat knitting machine
4 needle bed
6 carriage
8 knitting position
10 yarn feeder
12 knotter
13 yarn
14 second arm
16, 18 yarn guide
20 yarn length measuring device
21 servomotor
22, 23 roller
24, 27 yarn guide
26 first arm
30 controller
32 knitting data file
34 program storage medium
θ1, θ2 slack angle
enc encoder value
Bmax maximum buffer length
B buffer length
L yarn guide length
W remaining length to be knitted
M margin

BEST MODE FOR CARRYING OUT THE INVENTION

The best mode for carrying out the present invention is described hereinafter.

FIG. 1 through FIG. 8 show the embodiments and a modification thereof. FIG. 1 through FIG. 4 show the first embodiment. In each figure, 2 is a flat knitting machine, and 4 is a needle bed. For example, a pair of beds may be provided in front and in back, or a total of four beds may be provided in front, in back, above and below, thus the number of needle beds 4 is arbitrary. 6 is a carriage that performs knitting by reciprocally travels on the needle bed 4, and a reference numeral 8 schematically indicates a knitting position. Further, a yarn feeder 10 travels in synchronization with the carriage 6 to feed yarn to knitting needles of the needle bed 4. It should be noted that, instead of using the carriage 6, a linear motor or the like may be used to control each knitting needle on the needle bed 4.

A knotter 12 that is attached to an upper section or the like of the flat knitting machine 2. This is an example for a yarn processing device. Yarn is supplied from a plurality of cones and the like, which are not shown, to the knotter 12. Yarn 13 that is presently supplied to the flat knitting machine 2 is cut and coupled with different yarn to form a knot, whereby the type of yarn is changed. Then, when the knotter 12 is operated, the yarn is checked inside the knotter 12, the feeding speed of the yarn is set to zero or low speed, and preferably the yarn on the exit side of the knotter 12 (yam on a downstream side in relation to the knot) is applied with tension so that yarn processing is performed easily.

14 is a second arm that is released to apply tension when processing the yarn 13 using the knotter 12, but is usually locked to minimize the buffer length of the yarn at the second arm 14. The arm direction of the second arm 14 (slack angle) is expressed as θ2. It should be noted that the second arm 14 may not be provided or may be embedded in the knotter 12. Here, although a sensor for measuring the slack angle θ2 is not provided, such sensor for measuring the slack angle θ2 may be provided.

16 and 18 are yarn guides. The yarn 13 that has passed through the second arm 14 from the knotter 12 is sent to a yarn length measuring device 20. In the yarn length measuring device 20, for example, a pair of rollers 22, 23 are rotated by a servomotor 21 so as to allow the yarn 13 to pass between the rollers 22, 23, and the yarn 13 of a required length is reeled out or rewound. Then, for example, rotation angle or the like of the roller 22 or motor 21 is read by an unshown encoder, and the length of the yarn that has passed through the yarn length measuring device 20 is outputted as an encoder value enc. Since the yarn can be reeled out and rewound, the encoder value enc not only increases but also decreases. Although the yarn length measuring device 20 is of a type that can actively reel out/rewind the yarn 13, it may be of a type that simply measures the distance passed by the yarn by using the encoder. An embodiment in which such simple yarn length measuring device is used is shown in FIG. 5 through FIG. 8.

24 and 27 are, for example, a pair of yarn guides provided with a first arm 26 therebetween, the first arm 26 being provided on a side or the like of the needle bed 4 as well. The first arm 26 is an arm for buffering the yarn 13 while applying tension, and a slack angle thereof, i.e., the arm direction, is expressed as θ1. Then, the slack angle θ1 of the arm 26 is measured by an unshown angle sensor, and outputted to a controller 30.

The controller 30 is embedded in the flat knitting machine 2, reads knitting data from knitting data file 32, controls the carriage 6, and cause each knitting needle of the needle bed 4 to perform necessary operation. In addition, the controller 30 controls the speed of the carriage 6 and the timing for locking/releasing the second arm 14, the timing at which the yarn is reeled out or rewound by the yarn length measuring device 20, and the timing at which the knotter 12 processes the yarn. The present position of the carriage 6, the encoder value enc that is obtained by the yarn length measuring device 20, the slack angle θ1 of the first arm 26 and the like are input to the controller 30. In the case where the angle sensor is provided in the second arm 14 as well, the slack angle θ2 may be input 34 is a storage medium for storing a program of the yarn processing control device, and stores commands to cause the controller 30 to execute the process shown in FIG. 3, FIG. 4, FIG. 6 or FIG. 7.

In a preliminary stage for defining the operation timing and the like of the knotter 12, yarn guide length L between a yarn processing position within the knotter 12 and a knitting position 8 is measured. The yarn guide length L can be divided into a section L1, which is located on an upstream side of a yarn guide 27 on the front side of the needle bed 4, and a second L2, which is located on a downstream side of the same. The section L1 may be measured in a state in which the second arm 14 is locked to minimize the buffer length and the slack length θ1 of the first arm 26 and the buffer length thereon are maximized. In order to do so, for example, the yarn between the yarn processing position within the knotter 12 and the yarn guide 27 may be cut to measure the length thereof manually. Alternately, after a knot is formed by the knotter 12, the distance in which the knot passes through the yarn guide 27 may be obtained by the yarn length measuring device 20. It is arbitrary how the border between the section L1 on the upstream side and the section L2 on the downstream side is defined on the yarn guide length L. For example, a reference position may be defined in the vicinity of one end of the needle bed 4, and then taken as the border to define the section L1 on the upstream side and the section L2 on the downstream side.

Yarn guide length L2 between the yarn guide 27 and the knitting position 8 is computed from the knitting data. The yarn guide length L2 becomes different values depending on the direction of the needle bed 4, i.e., right or left, with respect to the reference position of the needle bed 4. This embodiment describes how the yarn guide lengths L1, L2 are obtained individually, but actually the total of these lengths, the yarn guide length L, may be obtained.

The timing at which the knotter 12 processes the yarn is described in the knitting data file 32. A point for setting the knitting speed of the carriage 6 to zero or low speed (point C) is obtained before processing the yarn, thus the consumed yarn length of each loop to be knitted from a changeover position, which is located on a knitting fabric for changing over a knitting yarn to an after-processed yarn, to an actuating position of the yarn processing device is added reversely to the order of knitting, whereby a total value (remaining length to be knitted W) is obtained on the knitting data. L1max is obtained based on the assumption that the buffer length on the second arm 14 is minimized and the buffer length on the first arm 26 is maximized, and the position of the carriage 6 is computed from the knitting data on the basis of the obtained L1max, whereby the yarn guide length L is obtained. Next obtained is a point at which the remaining length to be knitted W matches with the yarn guide length that is based on the assumption that the buffer length on the first arm 26 is maximized. This point is the point C.

A deceleration pattern of the carriage 6 is defined such that the carriage stops or decelerates to a low speed at the point C. Consequently, as long as the buffer length of the yarn at the first arm 26 is not maximum, the timing for processing the yarn does not arrive when the carriage has stopped or decelerated to a low speed, whereby a margin M is created until the yarn processing timing arrives. It is extremely rare that the buffer length of the yarn at the first arm 26 is maximized, thus it is realistically impossible that the buffer length at the first arm 26 becomes the maximum value at the point of time when the carriage 6 stops or decelerates to a low speed. Further, in the case where the angle sensor is provided in the second arm 14 as well, normally the second arm 14 is released, and the point C may be computed based on the assumption that the first arm 26 and the second arm 14 each buffers the yarn of the maximum buffer length.

Figure 2:
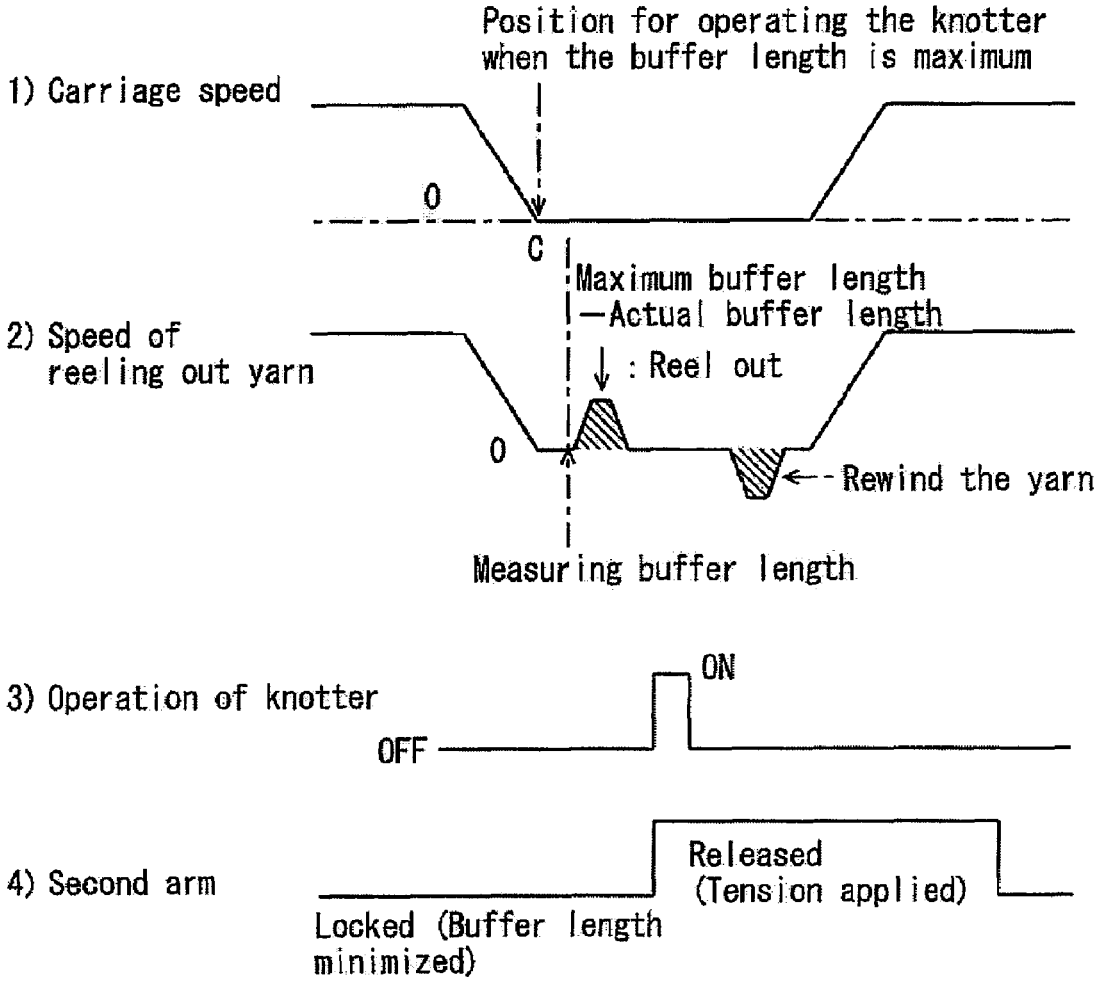
FIG. 2 is a timing chart showing procedures for processing yarn in the embodiment, wherein 1) shows a speed pattern of a carriage, 2) shows a pattern of reeling out and back the yarn, 3) shows an operation of a knotter, and 4) shows a state of a second arm.
Figure 3:
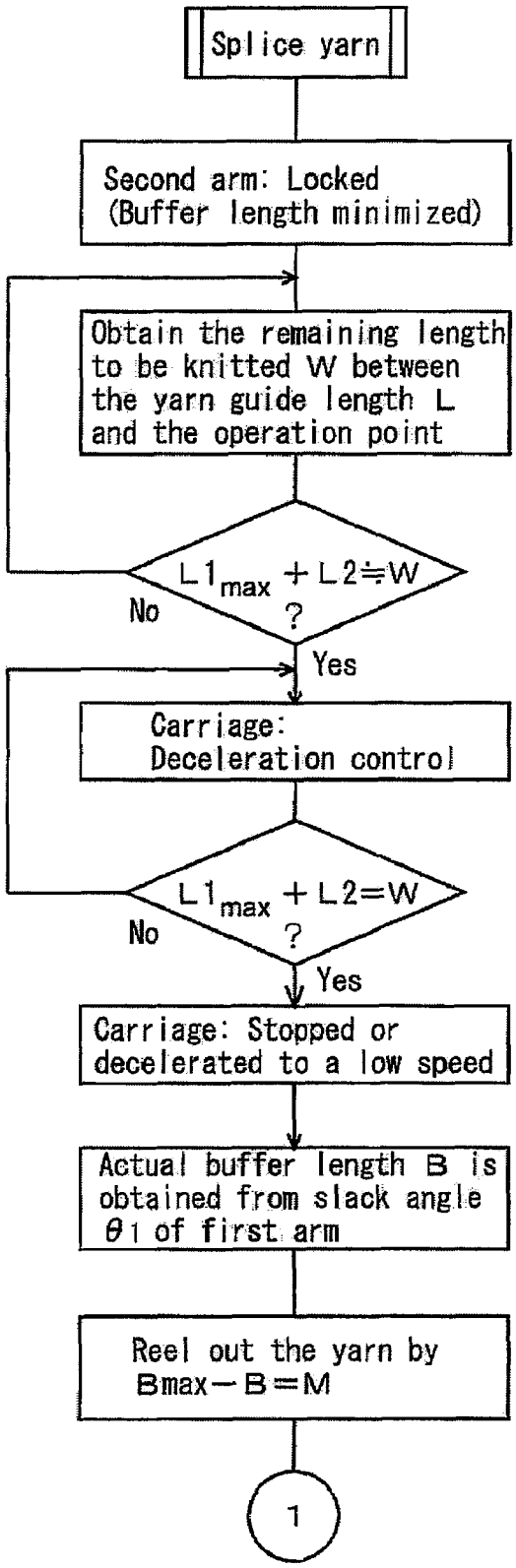
FIG. 3 is a flowchart showing a yarn processing algorithm of the embodiment.
Figure 4:
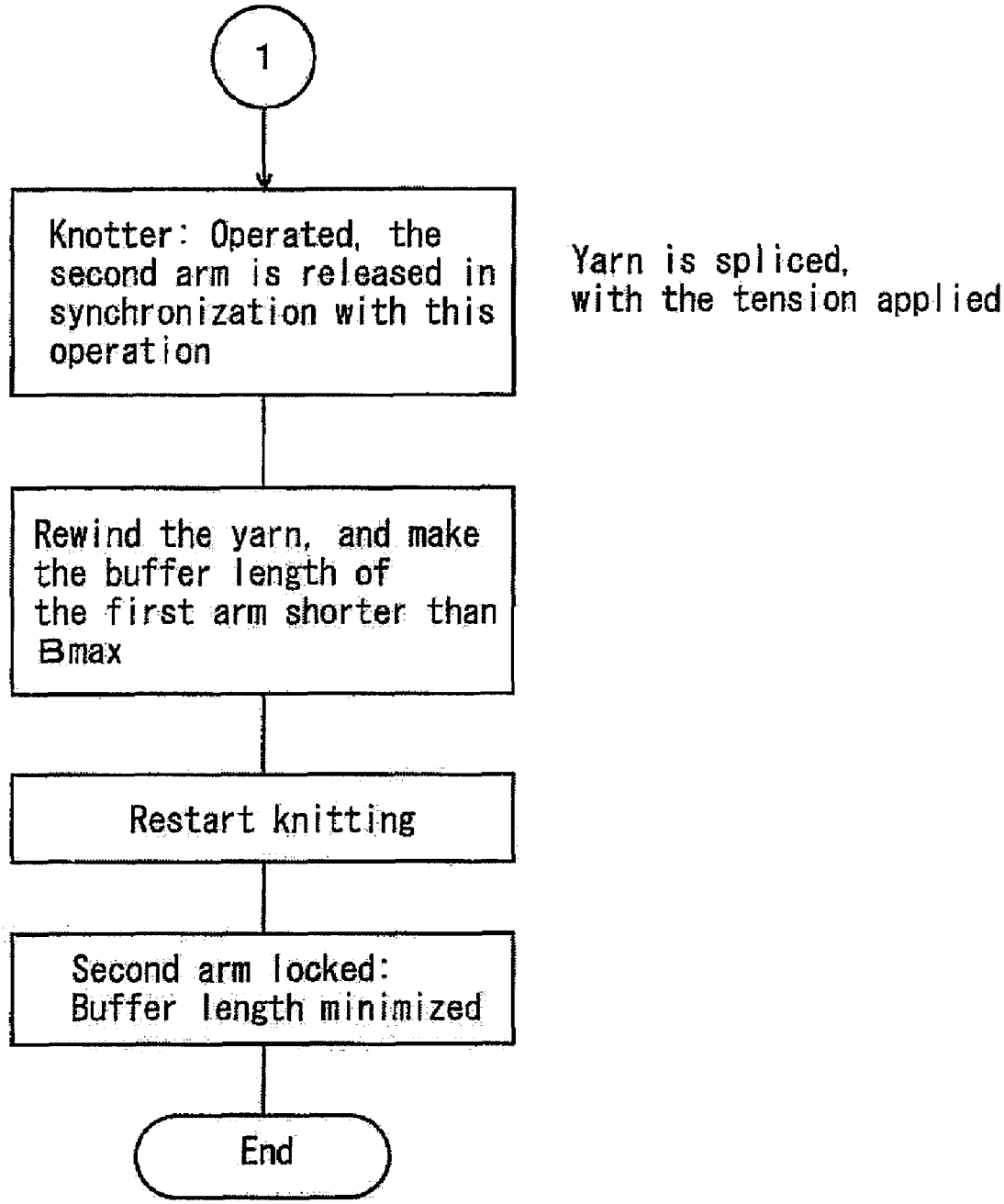
FIG. 4 is a flowchart showing an algorithm subsequent to the connector 1 shown in FIG. 3.

FIG. 2 through FIG. 4 each shows an algorithm for decelerating the carriage and sending an operation signal to the knotter 12. When assuming that the buffer length at the first arm 26 is maximum, the deceleration pattern of the carriage is defined such that the carriage stop at the position (point C) where the yarn guide length L is equal to the remaining length to be knitted W. It should be noted that the carriage may be decelerated to a low speed, instead of stopping the carriage. Once the carriage stops, the slack angle θ1 of the first arm 26 is measured, and actual buffer length B at the first arm is obtained from the slack angle θ1. Then, by using the yarn length measuring device 20 to operate the knotter 12 such that the yarn is reeled up by an amount of Bmax−B of the margin M, the yarn can be processed at the point matching the knitting data. It should be noted that the Bmax is the maximum buffer length of the first arm 26. The operation signal is transmitted from the controller 30 to the knotter 12 once the yarn of the margin M is reeled out from the point C. In synchronization with this input, at substantially the same timing, the second arm 14 is locked to apply tension to the yarn. At this moment, checking the yarn within the knotter 12 and releasing the second arm 14 are performed almost simultaneously, thus the length of the yarn to be newly reeled out by releasing the second arm 14 can be ignored.

In this manner, yarn processing is performed by the knotter 12 at the position matching the knitting data. Since the yarn length measuring device 20 reels out the yarn of a length corresponding to Bmax−B, the first arm 26 buffers the yarn of approximately the maximum buffer length, and restarting of knitting in such state might reduce the tension. For this reason, for example, knitting is restarted after rewinding the yarn of the length corresponding to Bmax−B by means of the yarn length measuring device 20, and then the second arm 14 is locked. It is important to measure the slack angle θ1 and the buffer length B after the carriage 6 stops or decelerates to a low speed. The slack angle θ1 is changed by yarn consumption speed on the carriage 6 side, thus the slack angle θ1 is generally different before and during deceleration of the carriage or after the carriage stops.

FIG. 5 through FIG. 8 shows the second embodiment and a modification thereof. This embodiment uses a yarn length measuring device that does not have the servomotor 21, measures the length of the yarn that has passed through the yarn length measuring device, and does not reel out or rewind the yarn. Therefore, the yarn of a length corresponding to Bmax−B=M is reeled out before operating the knotter 12, thus the carriage 6 is caused to travel at low speed to draw out the yarn of this length by knitting. Other points of this embodiment are the same as those of the embodiment shown in FIG. 1 through FIG. 4.

Figure 5:
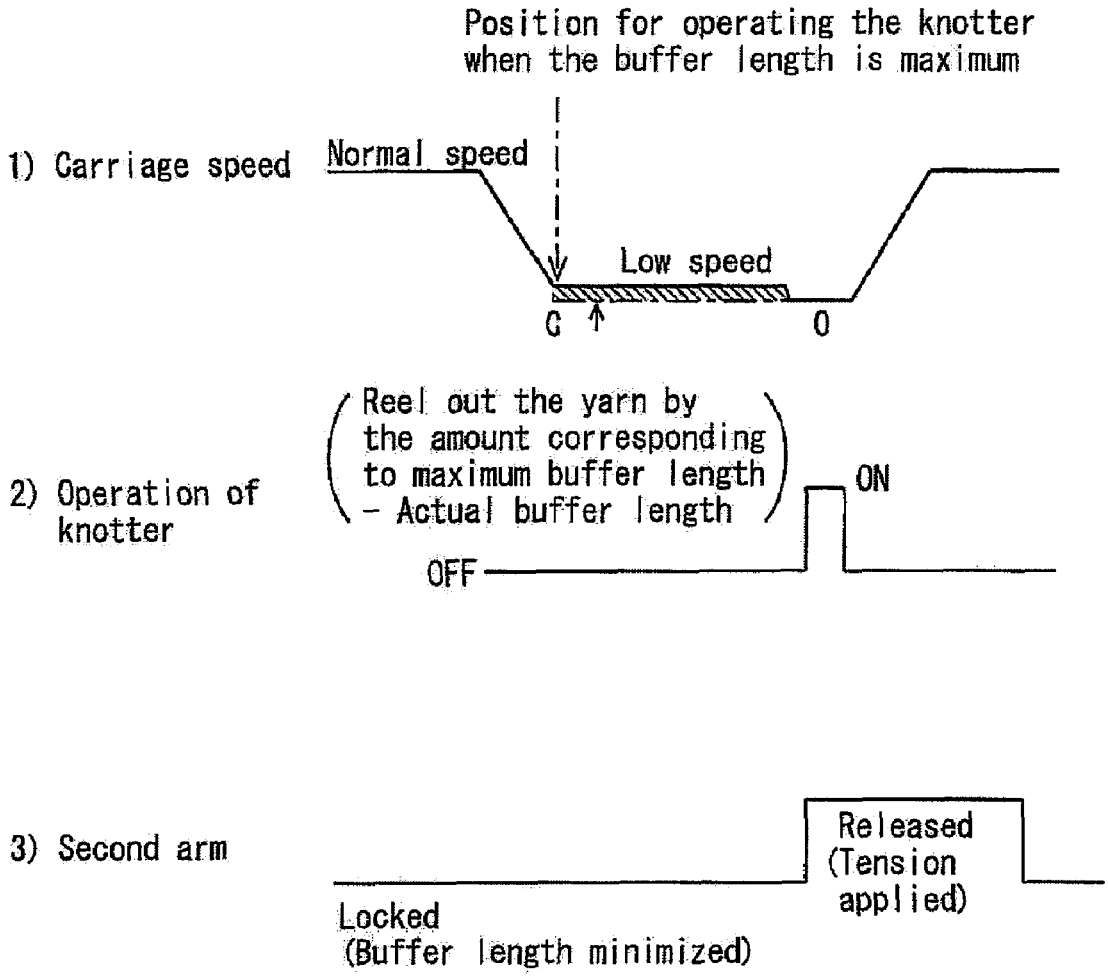
FIG. 5 is a timing chart showing procedures for processing yarn in a second embodiment, wherein 1) shows a speed pattern of the carriage, 2) shows an operation of the knotter, and 3) shows a state of the second arm.
Figure 6:
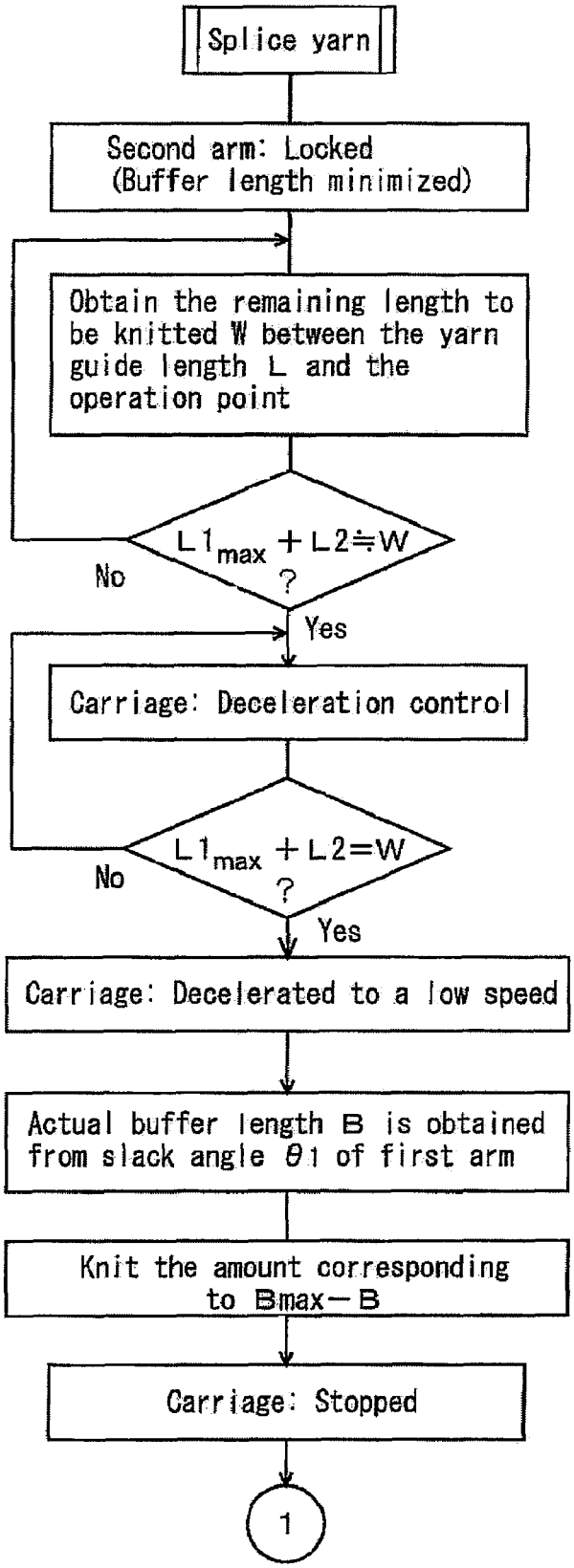
FIG. 6 is a flowchart showing a yarn processing algorithm of the second embodiment.
Figure 7:
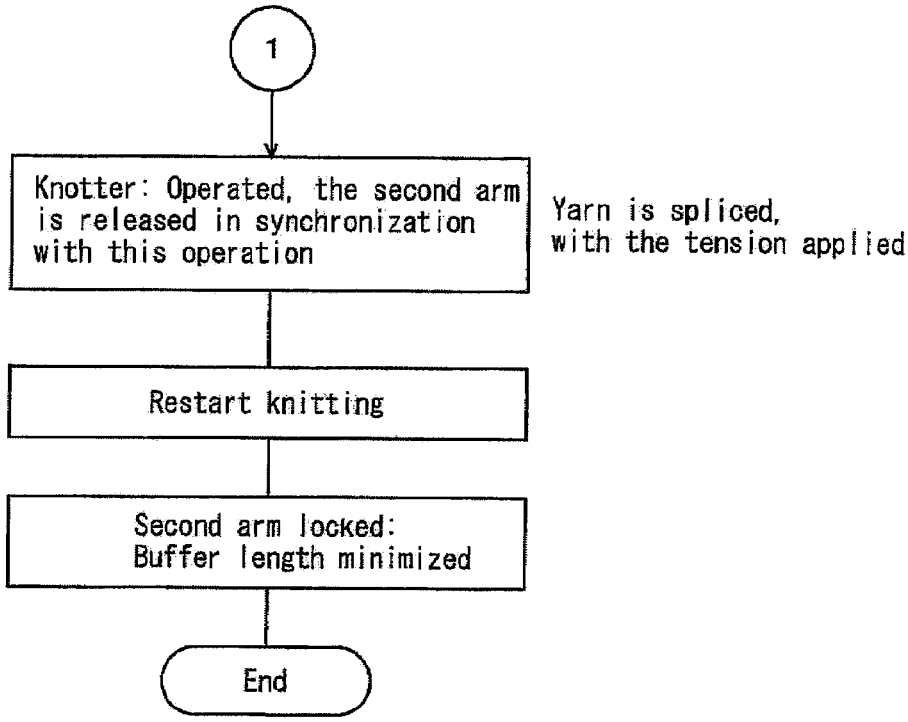
FIG. 7 is a flowchart showing an algorithm subsequent to the connector 1 shown in FIG. 6.

As shown in FIG. 5 through FIG. 7, the carriage is controlled to be decelerated from a normal speed to a low speed at the point C described above. The carriage 6 is then caused to travel at a low speed by the length corresponding to the maximum buffer length Bmax−actual buffer length B, and the yarn is reeled out by knitting. Once the yarn has been reeled out, the carriage 6 is stopped once and the knotter is operated. Furthermore, the second arm is released in synchronization with operation of the knotter, knitting is restarted after operation of the knotter is ended, and thereafter the second arm is locked again. It should be noted that when operating the knotter, the carriage may be caused to travel at a low speed, instead of stopping the carriage.

Figure 8:
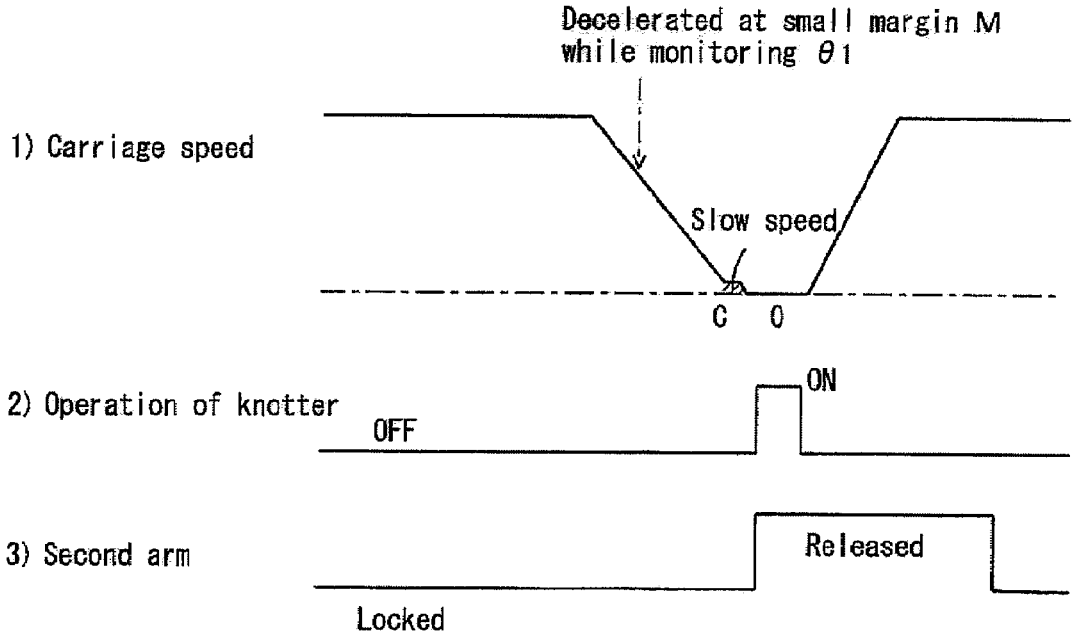
FIG. 8 is a timing chart showing procedures for processing yarn in a modification of the second embodiment, wherein 1) shows a speed pattern of the carriage, 2) shows an operation of the knotter, and 3) shows a state of the second arm.

In this embodiment, Bmax−B is used as the margin on the point C. However, this value may be much smaller. In FIG. 8 showing a modification of the embodiment shown in FIG. 5 through FIG. 7, the slack angle θ1 is monitored, and at the same time the carriage is controlled to be decelerated at a margin M that is smaller than the value of Bmax−B. Then, the carriage 6 is caused to continue knitting the yarn of a length corresponding to the remaining margin, and the knotter is operated, in synchronization with which the second arm is released.

In the case where the embodiment shown in FIG. 1 through FIG. 4 is combined with the modification shown in FIG. 8, the carriage may be stopped at a position upstream by a slight margin M than the yarn processing timing position while monitoring the slack angle θ1, the value of the margin may be then measured from the slack angle θ1, the yarn of a length corresponding to thus obtained value may be reeled out by the yarn length measuring device 20, and the knotter may be operated. Other points of this embodiment may be configured the same as those of the embodiment shown in FIG. 1 through FIG. 4.

In this embodiment, although the yarn length measuring device 20 is used at the time of yarn processing, but the timing for yarn processing can be obtained without using the yarn length measuring device 20. For example, when starting knitting, the knitting conditions of the knitting machine are adjusted while monitoring yarn consumed amount such that the yarn consumed amount becomes a desired value, and thereafter knitting may be performed without measuring the yarn consumed amount. Also, the yarn length measuring device may not be provided at all. Moreover, it is not necessary to change the knitting pattern at the position where yarn processing is performed. For example, before and after the yarn processing position, the knitting data may be defined such that a predetermined length of yarn is drawn out onto the back of the knitting fabric so that the yarn processing position appears on the back of the knitting fabric so that the yarn is invisible on the front side. Accordingly, there is no problem as long as a margin of error of the yarn processing position is equal to or less than the length of the yarn drawn out onto the back of the knitting fabric.

According to this embodiment, the yarn can be processed at a predetermined position based on the knitting data without affected by the margin of error cased by the buffer length on the first arm. Although the embodiment described the knotter, a splicer, an adhering device, a dyeing apparatus or the like may be used as the yarn processing device.

The invention claimed is:

1. A knitting machine that supplies yarn from a yarn processing device to a knitting needle of a needle bed in order of a buffering arm and a yarn feeder, compares remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at a position of actuating the yarn processing device to feed the knitting yarn to the knitting needle, and thereby controlling a timing for operating the yarn processing device, the knitting machine comprising:

a sensor for obtaining buffer length of the arm from a direction of the arm;

means for comparing the yarn guide length L in preset buffer length of the arm with the remaining length to be knitted W, to control deceleration of knitting speed so that the knitting speed becomes zero or a low speed at the needle bed at the point of time when a yarn feeding position C is reached when L≦W is satisfied; and timing means for obtaining the buffer length of the arm at the yarn feeding position C by means of the sensor, and operating the yarn processing device at the point of time when reeling out, from the yarn processing device side to the needle bed side, yarn of a length corresponding to a difference between the preset buffer length of the arm and the buffer length obtained by the sensor.

2. The knitting machine according to claim 1, wherein the preset buffer length of the arm is substantially equal to the maximum buffer length of the arm.

3. The knitting machine according to claim 1, further comprising a roller and a motor for reeling out yarn, wherein the motor is used to reel out, from the yarn processing device side to the needle bed side, the yarn of a length corresponding to the difference between the preset buffer length of the arm and the buffer length obtained by the sensor.

4. The knitting machine according to claim 1, wherein the yarn feeder is moved at a low speed to draw out, by knitting operation, the yarn of a length corresponding to the difference between the preset buffer length of the arm and the buffer length obtained by the sensor.

5. The knitting machine according to claim 3, wherein a yarn length measuring device is provided between the yarn processing device and the buffering arm.

6. A yarn processing method of the knitting machine for supplying yarn from a yarn processing device to a knitting needle of a needle bed in order of a buffering arm and a yarn feeder, comparing remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at a position of actuating the yarn processing device to feed the knitting yarn to the knitting needle, and thereby controlling the timing for operating the yarn processing device, wherein the knitting machine is provided with a sensor for obtaining buffer length of the arm from the direction of the arm, and wherein the yarn processing method comprises steps of:

comparing the yarn guide length L in preset buffer length of the arm with the remaining length to be knitted W, and controlling deceleration of knitting speed so that the knitting speed becomes zero or a low speed at the needle bed at the point of time when a yarn feeding position C is reached when L≦W is satisfied; and obtaining the buffer length of the arm at the yarn feeding position C by means of the sensor, and operating the yarn processing device at the point of time when reeling out, from the yarn processing device side to the needle bed side, yarn of a length corresponding to the difference between the preset buffer length of the arm and the buffer length obtained by the sensor.

7. A yarn processing control device for a knitting machine for controlling yarn processing by supplying yarn from a yarn processing device to a knitting needle of a needle bed in order of a buffering arm and a yarn feeder, comparing remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at a position of actuating the yarn processing device to feed the knitting yarn to the knitting needle, and thereby controlling the timing for operating the yarn processing device, the yarn processing control device comprising:

a sensor for obtaining buffer length of the arm from the direction of the arm;

means for comparing the yarn guide length L in preset buffer length of the arm with the remaining length to be knitted W, to control deceleration of knitting speed so that the knitting speed becomes zero or a low speed at the needle bed at the point of time when a yarn feeding position C is reached when $L \leqq W$ is satisfied; and timing means for obtaining the buffer length of the arm at the yarn feeding position C by means of the sensor, and operating the yarn processing device at the point of time when reeling out, from the yarn processing device side to the needle bedside, yarn of a length corresponding to the difference between the preset buffer length of the arm and the buffer length obtained by the sensor.

8. A yarn processing control device program, stored on a processing control device readable storage medium, for a knitting machine for controlling yarn processing by supplying yarn from a yarn processing device to a knitting needle of a needle bed in order of a buffering arm and a yarn feeder, comparing remaining length to be knitted W, which is a total value obtained from knitting data and obtained by summing up consumed yarn length of each loop to be knitted from a changeover position on a knitting fabric for changing over a knitting yarn to an after-processed yarn to an actuating position of the yarn processing device, with yarn guide length L between the yarn processing device and a yarn feeding position at a position of actuating the yarn processing device to feed the knitting yarn to the knitting needle, and thereby controlling the timing for operating the yarn processing device, the program comprising:

a command to compare the yarn guide length L in preset buffer length of the arm with the remaining length to be knitted W, to control deceleration of knitting speed so that the knitting speed becomes zero or a low speed at the needle bed at the point of time when a yarn feeding position C is reached when $L \leqq W$ is satisfied; and a timing command to obtain the buffer length of the arm at the yarn feeding position C by means of the sensor, to operate the yarn processing device at the point of time when reeling out, from the yarn processing device side to the needle bed side, yarn of a length corresponding to the difference between the preset buffer length of the arm and the buffer length obtained by the sensor.

* * * * *